US010851480B2

(12) United States Patent
Wang

(10) Patent No.: US 10,851,480 B2
(45) Date of Patent: Dec. 1, 2020

(54) RECYCLED FANCY YARN AND MANUFACTURING METHOD THEREOF

(71) Applicant: Chang-Ching Wang, Taipei (TW)

(72) Inventor: Chang-Ching Wang, Taipei (TW)

( * ) Notice: Subject to any disclaimer, the term of this patent is extended or adjusted under 35 U.S.C. 154(b) by 35 days.

(21) Appl. No.: 16/157,072

(22) Filed: Oct. 10, 2018

(65) Prior Publication Data

US 2019/0382926 A1 Dec. 19, 2019

(30) Foreign Application Priority Data

Jun. 19, 2018 (TW) ..... 107120979

(51) Int. Cl.
*D02G 3/34* (2006.01)
*D02G 3/38* (2006.01)

(52) U.S. Cl.
CPC ..... *D02G 3/34* (2013.01); *D02G 3/38* (2013.01)

(58) Field of Classification Search
CPC .. D02G 3/34; D02G 3/38; D02G 3/02; D02G 3/042
USPC ..... 57/203, 24, 210, 207
See application file for complete search history.

(56) References Cited

U.S. PATENT DOCUMENTS 2,201,759 A * 5/1940 Bry ..... D04D 1/00 57/207
3,458,988 A * 8/1969 Preston ..... D01H 5/36 57/207
4,196,573 A * 4/1980 Perry ..... D02G 3/34 57/12
4,219,996 A * 9/1980 Edgawa ..... D02G 3/34 57/225
4,729,215 A * 3/1988 Sato ..... D02G 3/38 57/2
4,750,324 A * 6/1988 Tochacek ..... D02G 3/32 57/210
6,705,069 B1 * 3/2004 Talley ..... D02G 3/045 57/206
7,678,450 B2 * 3/2010 Kitamura ..... D02G 3/46 428/370
2006/0116041 A1 * 6/2006 Hou ..... D03D 15/0033 442/195

FOREIGN PATENT DOCUMENTS

EP 0439659 A1 * 8/1991 ..... D02G 3/34
WO WO-2019012916 A1 * 1/2019 ..... D02G 3/38

* cited by examiner

*Primary Examiner* — Shaun R Hurley
*Assistant Examiner* — Patrick J. Lynch

(57) ABSTRACT

A recycled fancy yarn includes at least two core strands forming a warp thread, and at least one ornamental strand that is twined, twisted or wound around the warp thread to form a weft thread. The core strand is formed by a single first monofilament or a single first filament bundle, and the ornamental strand is formed by a single second monofilament or a single second filament bundle. The first monofilament and/or second monofilament is made of an environmentally friendly material; or the recycled fancy yarn can be recycled or naturally decomposed in the environment, such that the quantity of produced wastes can be reduced, and environmental burden is hardly caused.

4 Claims, 14 Drawing Sheets

RECYCLED FANCY YARN AND MANUFACTURING METHOD THEREOF

CROSS REFERENCE TO RELATED APPLICATIONS

The present application claims the benefit of Taiwanese patent application No. 107120979 filed on Jun. 19, 2018, the contents of which are hereby incorporated by reference.

BACKGROUND OF THE INVENTION

1. Technical Field

The present invention relates to a fancy yarn, and in particular, to a recycled fancy yarn that is made of an environmentally friendly material or can be recycled.

2. Background

With the development of global industry, humans use fossil fuel in a large quantity, destructively cut down the forests, use chloride- and fluorine-containing carbide, and frequently do agricultural and industrial activities, resulting in a sharp increase of gas that easily absorbs long-wavelength radiation, which is also called greenhouse gas (GHG) such as carbon dioxide, methane, nitrous oxide, chlorofluorocarbons, sulfur hexafluoride, perfluorocarbons, and hydrofluorocarbons. A greenhouse effect is then incurred, such that the Earth's temperature rises. According to the research, in the past 100 years, the global average surface temperature has increased by about 0.7° C. due to global warming, and the sea level also has been rising all the time.

The greenhouse effect may cause an abnormal climate change and pose a foreseeable impact and threat to the environment. For example: 1. The global climate changes, causing an abnormal rainstorm and drought, and impacting water and soil resources, environmental sanitation and human life; 2. as the global average temperature rapidly and continuously rises, melting of the polar ice sheets accelerates, and the Arctic ice circle shrinks at a rate of about 9% per decade, resulting in a rise of the sea level, reduction of the land area, and a great impact on the human living environment; 3. desertification aggravates and ecosystems are changed, impacting the environment of agriculture, forestry, fishery and animal husbandry, and seriously damaging ecological habitats such as coral reefs and alpine grasslands, such that many animals and plants face the crisis of extinction; and 4. the global warming may increase the intensity of hurricanes and typhoons, and as the ocean temperature rises, tropical storms may absorb more energy and the power becomes stronger, such that the occurrence of global strong hurricanes and typhoons has almost doubled in the past few decades.

The influence of global warming on the climate and environment has brought an unprecedented impact on the Earth's ecology and humanity. The relevant topics, such as holes in the ozone layer, climate warming, energy shortage caused by excessive development, natural environment destruction and pollution, and the like, have aroused a shock and discussion internationally. If warming of the global climate continues and no improvement is made to the environmental pollution situation, the environment of the entire planet will be seriously threatened in the future. How to reduce the environmental pollution and use energy efficiently has become an important issue for governments to solve urgently.

As described above, global warming has obviously impacted the living environment of the living things on the Earth. People begin to realize their own living environment and enhance the importance of ecological environmental protection, to slowdown global warming, such that people form a green consumption concept which concerns organic, natural, and environmentally friendly products. Thus, green textiles and environmentally friendly ecological textiles have also become the international development trend and focus of attention.

SUMMARY OF THE INVENTION

In view of this, based on experiences in development of related fiber varieties, and textile yarn manufacturing, research and development, and design, the inventors of the present invention review and study the above-mentioned green textiles and environmentally friendly eco-textiles, and prudently evaluate various improvements, to finally complete the present invention.

In other words, the present invention can provide a recycled fancy yarn made of a natural source material or a recyclable high-polymer material, which not only can alleviate environmental pollution and reduce the use of petrochemical raw materials, but also can reduce production of carbon dioxide and energy consumption, so as to resolve the crisis of global warming.

That is, the present invention can provide a recycled fancy yarn, including at least two core strands forming a warp thread, and at least one ornamental strand that is twined, twisted or wound around the warp thread to form a weft thread, where the core strand is formed by a single first monofilament or a single first filament bundle, the first filament bundle including a first straight-filament bundle formed by a plurality of paralleled first monofilaments or a first twisted-filament bundle formed by a plurality of twisted first monofilaments; the ornamental strand is formed by a single second monofilament or a single second filament bundle, the second filament bundle including a second straight-filament bundle formed by a plurality of paralleled second monofilaments or a second twisted-filament bundle formed by a plurality of twisted second monofilaments; and the first monofilament and/or second monofilament is made of an environmentally friendly material, or the recycled fancy yarn can be recycled or naturally decomposed in the environment, such that the quantity of produced wastes can be reduced, and environmental burden is hardly caused.

According to an implementation form of the recycled fancy yarn of the present invention, the ornamental strand is an opening-type yarn chain with openings or a closed-ring-type yarn chain with closed rings around the warp thread.

According to an implementation form of the recycled fancy yarn of the present invention, when the ornamental strand is the opening-type yarn chain with openings, the openings twine around the warp thread to form a helical structure.

According to an implementation form of the recycled fancy yarn of the present invention, the helical structure has equally or unequally spaced threads.

According to an implementation form of the recycled fancy yarn of the present invention, there is a plurality of ornamental strands, and two ends of each of the ornamental strands are both arranged on the same side of the warp thread.

According to an implementation form of the recycled fancy yarn of the present invention, there is a plurality of ornamental strands, and two adjacent ornamental strands wind around the warp thread in opposite directions.

According to an implementation form of the recycled fancy yarn of the present invention, there is a plurality of warp threads, the plurality of warp threads is longitudinally arranged in parallel; and the ornamental strand is an opening-type yarn chain with openings and/or a closed-ring-type yarn chain with closed rings around the multiple warp threads, and crosses the two warp threads arranged left and right to form one or multiple weft threads.

According to an implementation form of the recycled fancy yarn of the present invention, any two adjacent weft threads of the multiple weft threads are equally or unequally spaced.

According to an implementation form of the recycled fancy yarn of the present invention, there is a plurality of ornamental strands, and each ornamental strand twines around the left and right adjacent warp threads to form a closed structure.

According to an implementation form of the recycled fancy yarn of the present invention, the environmentally friendly material is a natural source material or a recyclable high-polymer material.

In addition, the present invention also provides a manufacturing method of a recycled fancy yarn, which includes the following steps: a step of forming a core strand: processing a single first monofilament or a single first filament buddle with a spinning machine to form a core strand; a step of forming an ornamental strand: processing a single second monofilament or a single second filament buddle with the spinning machine to form an ornamental strand; and a step of forming a fancy yarn: separately twisting the core strand and the ornamental strand that are obtained in the foregoing steps with a fancy yarn twister as required, to form at least one warp thread and at least one weft thread that are then made into a fancy yarn with a particular pattern, where the first filament bundle of the core strand includes a first straight-filament bundle formed by a plurality of paralleled first monofilaments or a first twisted-filament bundle formed by a plurality of twisted first monofilaments; and the second filament bundle of the ornamental strand includes a second straight-filament bundle formed by a plurality of paralleled second monofilaments or a second twisted-filament bundle formed by a plurality of twisted second monofilaments.

The features and implementations of the present invention are described in detail below with reference to the accompanying drawings as preferred embodiments.

DESCRIPTION OF NUMERALS

Figure 1A:
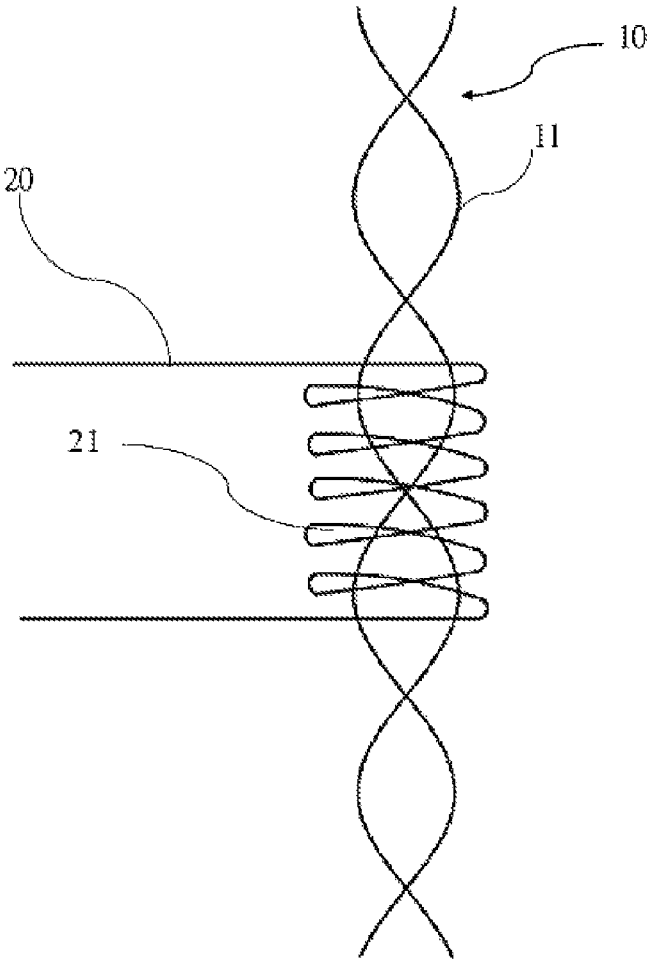
FIG. 1A and FIG. 1B are schematic structural diagrams of a first embodiment of the present invention.

P1, P2, P3 Recycled fancy yarn
a, b, c Region
10 Warp thread
11 Core strand
20 Ornamental strand
21 Opening
22 Closed ring
101 First warp thread
102 Second warp thread
103 Third warp thread
104 Fourth warp thread

DETAILED DESCRIPTION OF THE PREFERRED EMBODIMENTS

The technical means adopted by the present invention to achieve the intended purpose of the invention are further described below with reference to the accompanying drawings and preferred embodiments of the present invention. In terms of the detailed description and technical content of the present invention, the accompanying drawings are provided for the purpose of reference and description only, and are not intended to limit the present invention.

The implementation manners of the present invention are described below by using specific embodiments, and those with ordinary skill in the art can easily understand the present invention according to the content disclosed in the specification.

Figure 1B:
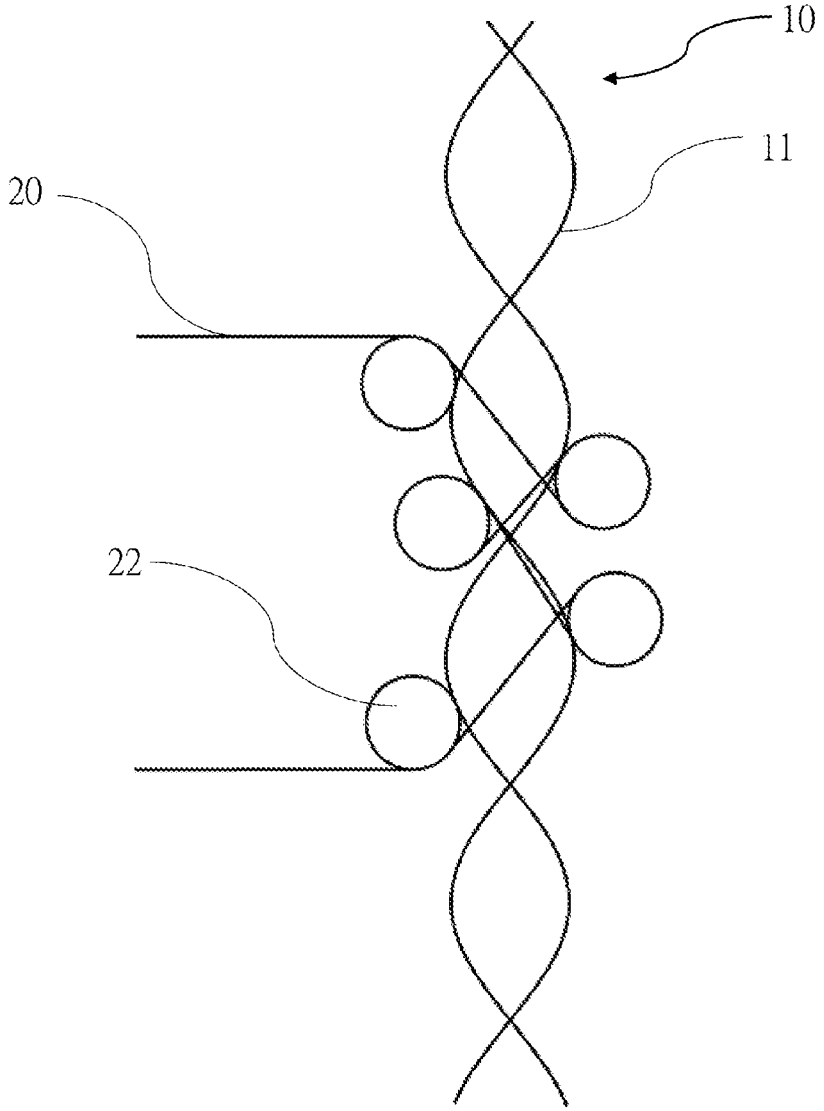

First, refer to FIG. 1A and FIG. 1B, which are schematic enlarged diagrams of a first embodiment of a recycled fancy yarn of the present invention. In this embodiment, the recycled fancy yarn includes at least two core strands 11 forming a warp thread 10, and at least one ornamental strand 20 that is twined, twisted or wound around the warp thread 10 to form a weft thread. As shown in FIG. 1A, the ornamental strand 20 is an opening-type yarn chain with openings. The openings 21 twine around the warp thread 10 to form a helical structure. The space between threads in the helical structure is not particularly limited, and the threads may or may not be equally spaced. In addition, in other embodiments of the present invention, the recycled fancy yarn may also include two ornamental strands 20 that wind around the warp thread 10 in opposite directions.

Moreover, as shown in FIG. 1B, the ornamental strand 20 may also be a closed-ring-type yarn chain with closed rings. The closed rings 22 twine around the warp thread 10 to form a knot structure. The size of the closed ring and the space therebetween are not particularly limited, and may be determined as required.

According to the technical idea of the present invention, the core strand 11 is formed by a single first monofilament or a single first filament bundle, the first filament bundle including a first straight-filament bundle formed by a plurality of paralleled first monofilaments or a first twisted-filament bundle formed by a plurality of twisted first monofilaments.

The ornamental strand 20 is formed by a single second monofilament or a single second filament bundle, the second filament bundle including a second straight-filament bundle formed by a plurality of paralleled second monofilaments or a second twisted-filament bundle formed by a plurality of twisted second monofilaments.

According to the technical idea of the present invention, the first monofilament and/or the second monofilament is made of an environmentally friendly material. After use, waste disposal is not required and thus environmental pollution is not caused, and the material can be recycled or naturally decomposed. This environmentally friendly material may be a natural source material such as cotton, bamboo fiber, rayon, chitin fiber, wool, silk, polylactic acid fiber, or coconut carbon fiber; or a recyclable high-polymer material such as recycled polyester or recycled nylon; or a material certified by the global recycled system.

For example, polyester widely used in the production of PET bottles is indecomposable and thus easily brings harm to the environment. As oil tends to be exhausted and the oil price is rising, polyester gradually attracts attention and becomes an important raw material of recycled environmentally-friendly textiles. Therefore, in the early years, countries have established a recycling system for the PET bottles to alleviate the environmental pressure that brooks no delay. By using polyester fiber recycled from the PET bottles as raw materials, damage to the environment brought by a large quantity of PET bottle wastes can be reduced, and oil consumption can also be lowered. The use of polyester fiber recycled from the PET bottles as raw materials saves nearly 80% more energy than use of original polyester fiber, that is, reduces the emission of carbon dioxide by 75%.

In addition, the polylactic acid fiber is obtained by using a natural raw material as a polymer material, for example, the polylactic acid fiber is fabricated by condensed polymerization of lactic acid obtained from starch of a substance such as corn. Discarded after use, the polylactic acid fiber can be decomposed into water and carbon dioxide in reaction with microbes in the soil. The produced carbon dioxide is then absorbed by plants through photosynthesis, and thus no pollution is caused to the Earth's environment. Therefore, the polylactic acid fiber is a biodegradable fiber that completely participates in natural circulation.

Moreover, natural-material products also have received attention in recent years. Genetic technology and genetic modification technology are used. For example, Spider genes are transferred to plant cells or goats to produce spider silk protein and make spider silk, or cotton genes are modified to produce colored cotton, or the like. Furthermore, coconut carbon fiber is obtained by recycling waste coconut shells, which can effectively reduce the wastes. Therefore, the above-described materials all can be used as fiber materials to make the first monofilament and the second monofilament of the present invention, and the fiber materials used to make the first monofilament and the second monofilament may be the same or different.

Figure 2A:
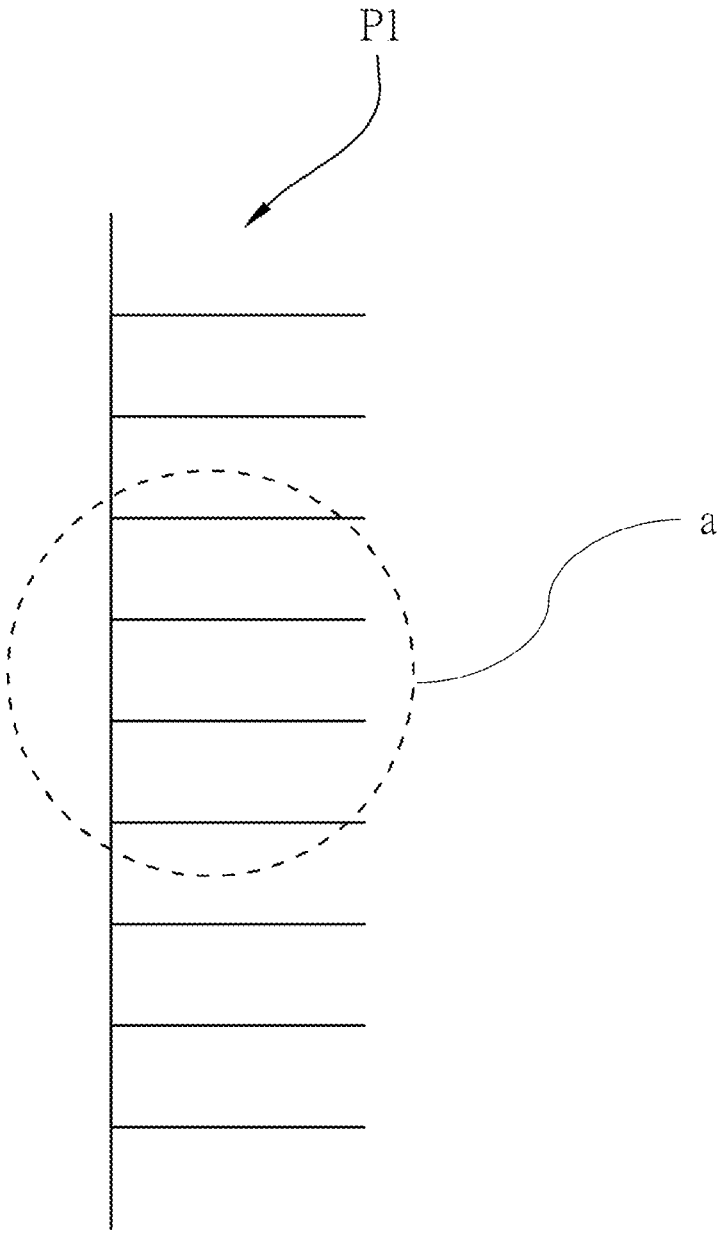
FIG. 2A is a schematic outline diagram of a second embodiment of the present invention.
Figure 2B:
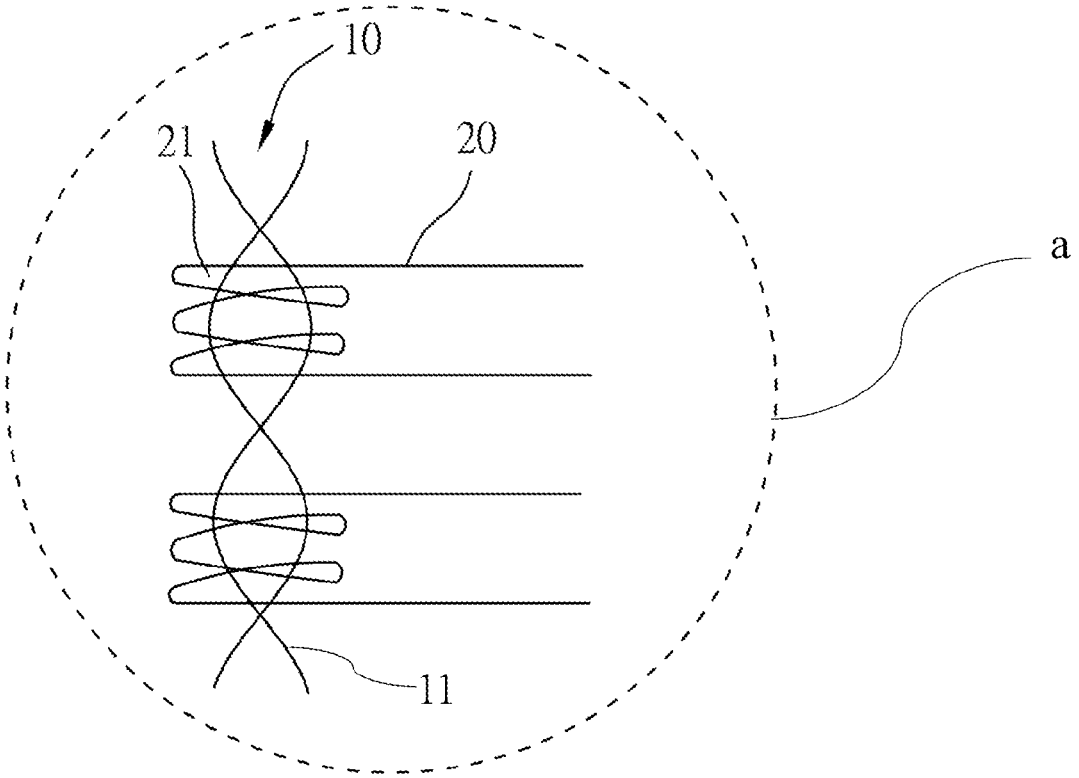
FIG. 2B is a partial enlarged diagram of a region a in FIG. 2A.
Figure 3A:
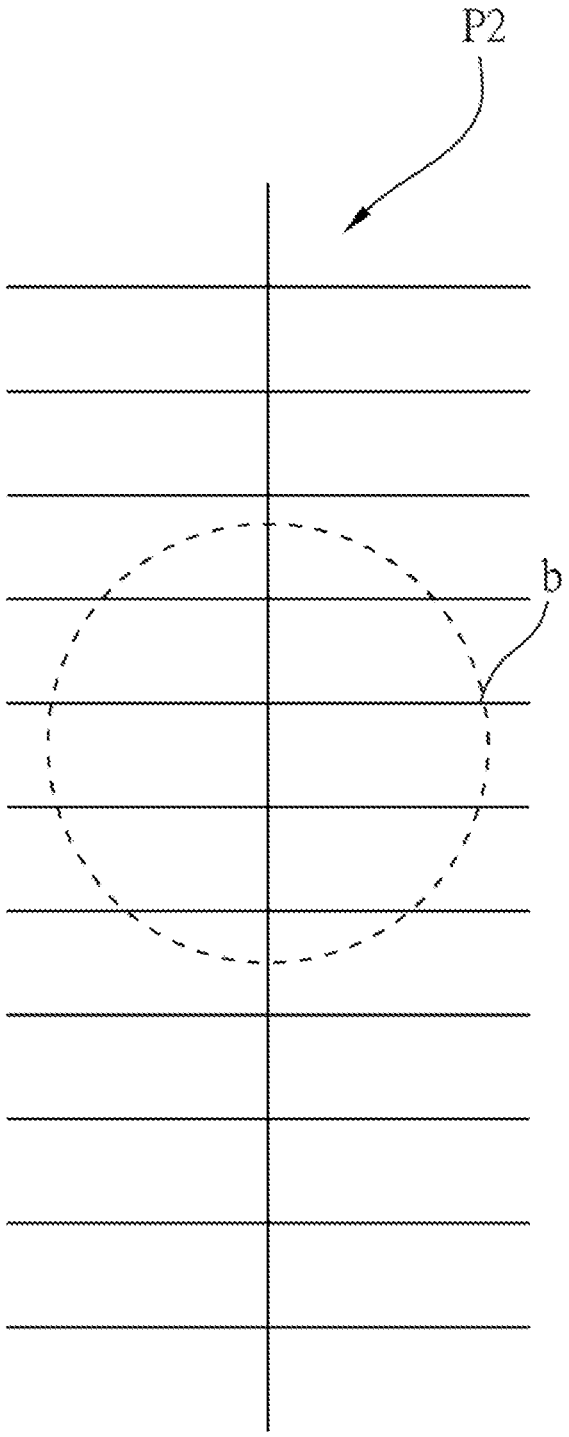
FIG. 3A is a schematic outline diagram of a third embodiment of the present invention.
Figure 3B:
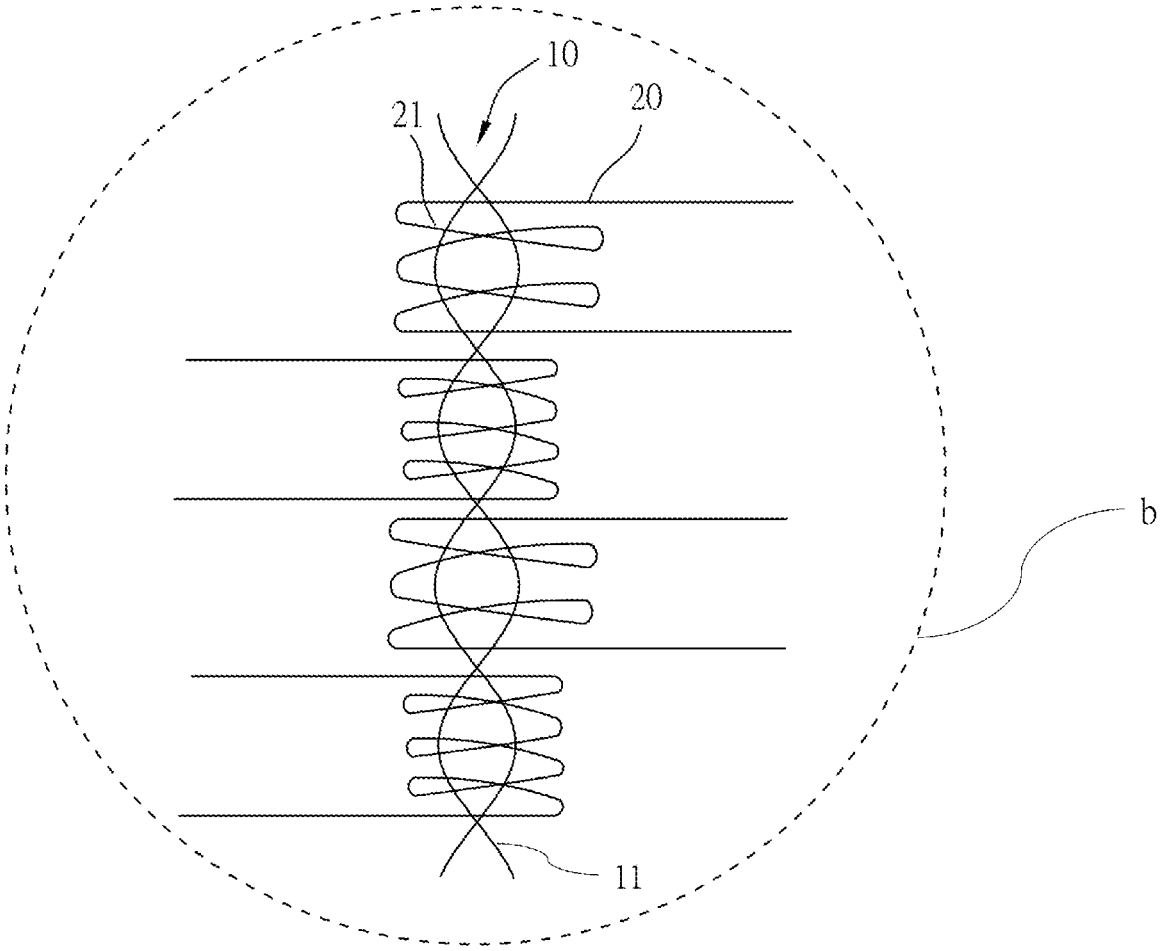
FIG. 3B is a partial enlarged diagram of a region b in FIG. 3A.

Afterwards, referring to FIG. 2A and FIG. 2B, FIG. 2A is a schematic outline diagram of a second embodiment of a recycled fancy yarn of the present invention, and FIG. 2B is a partial enlarged diagram of a region a in FIG. 2A. In this embodiment, the recycled fancy yarn P1 includes a warp thread 10 formed by two interwoven core strands 11 and a plurality of ornamental strands 20, where each ornamental strand 20 is an opening-type yarn chain with openings 21, and twines around the warp thread 10 to forma helical structure. Besides, two ends of each ornamental strand 20 are both arranged on the same side of the warp thread 10. Referring to FIG. 3A and FIG. 3B, FIG. 3A is a schematic outline diagram of a third embodiment of a recycled fancy yarn of the present invention, and FIG. 3B is a partial enlarged diagram of a region b in FIG. 3A. In this embodiment, any two adjacent ornamental strands 20 in the recycled fancy yarn P2 wind around the warp thread 10 in opposite directions, such that two ends of one of any two adjacent ornamental strands 20 are arranged on the left side of the warp thread 10, and two ends of the other one are arranged on the right side.

Figure 4A:
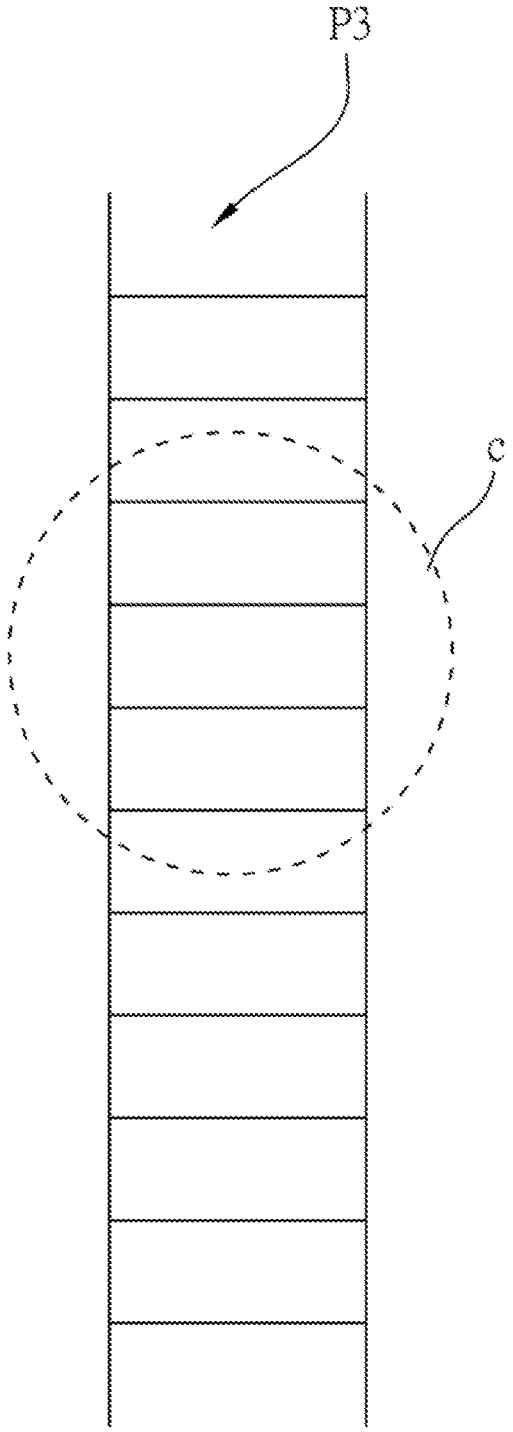
FIG. 4A is a schematic outline diagram of a fourth embodiment of the present invention.
Figure 4B:
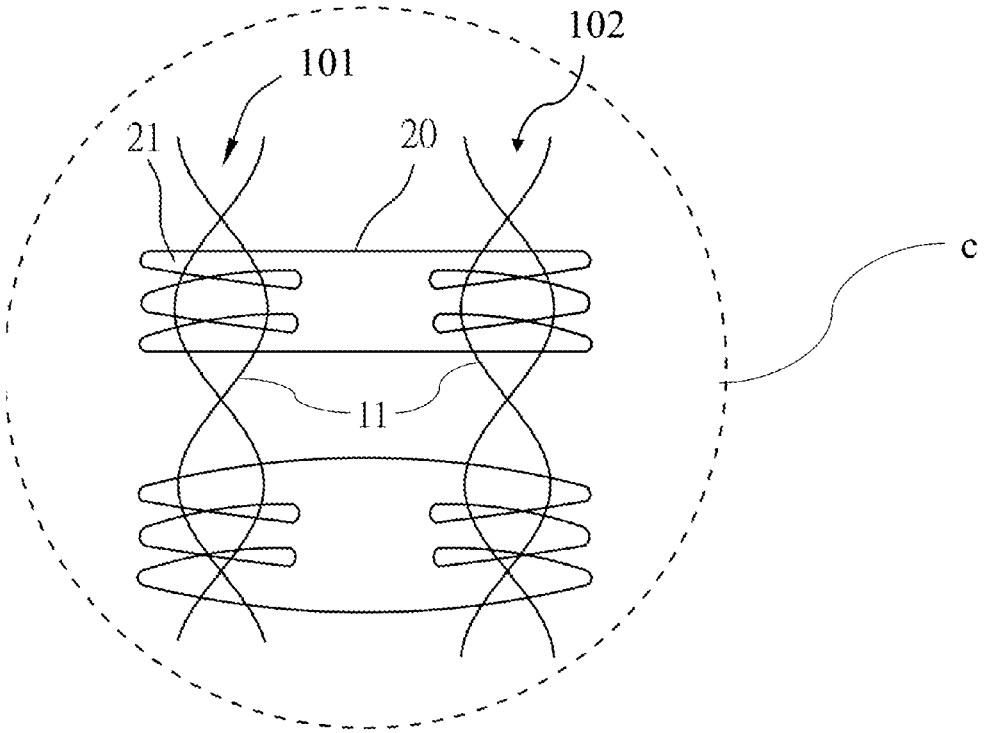
FIG. 4B is a partial enlarged diagram of a region c in FIG. 4A.

Moreover, referring to FIG. 4A and FIG. 4B, FIG. 4A is a schematic outline diagram of a fourth embodiment of a recycled fancy yarn of the present invention, and FIG. 4B is a partial enlarged diagram of a region c in FIG. 4A. In this embodiment, the recycled fancy yarn P3 includes a first warp thread 101 and a second warp thread 102 that are longitudinally arranged in parallel and each formed by two interwoven core strands 11. Each ornamental strand 20 is an opening-type yarn chain with openings 21, and each ornamental strand 20 twines around the left and right adjacent first warp thread 101 and second warp thread 102 to form an irregular closed structure, such that the recycled fancy yarn P3 presents a lattice-like structure. In addition, the tension in which the ornamental strands 20 twine around the first warp thread 101 and the second warp thread 102 may be adjusted so that the first warp thread 101 and the second warp thread 102 are unparalleled. Therefore, the recycled fancy yarn can have different outline patterns.

One ornamental strand 20 may also be used to twine around the left and right adjacent first warp thread 101 and second warp thread 102 continuously from top to bottom, such that the recycled fancy yarn P3 presents a lattice-like structure. For example, referring to FIG. 5A to FIG. 5C that show a fifth embodiment of a recycled fancy yarn of the present invention, the recycled fancy yarn includes a first warp thread 101 and a second warp thread 102 that are longitudinally arranged. The ornamental strand 20 twines around the left and right adjacent first warp thread 101 and second warp thread 102 to form one or multiple weft threads. A space between any two adjacent ones of the multiple weft threads is not particularly limited, and the spaces may be the same or different.

Figure 5A:
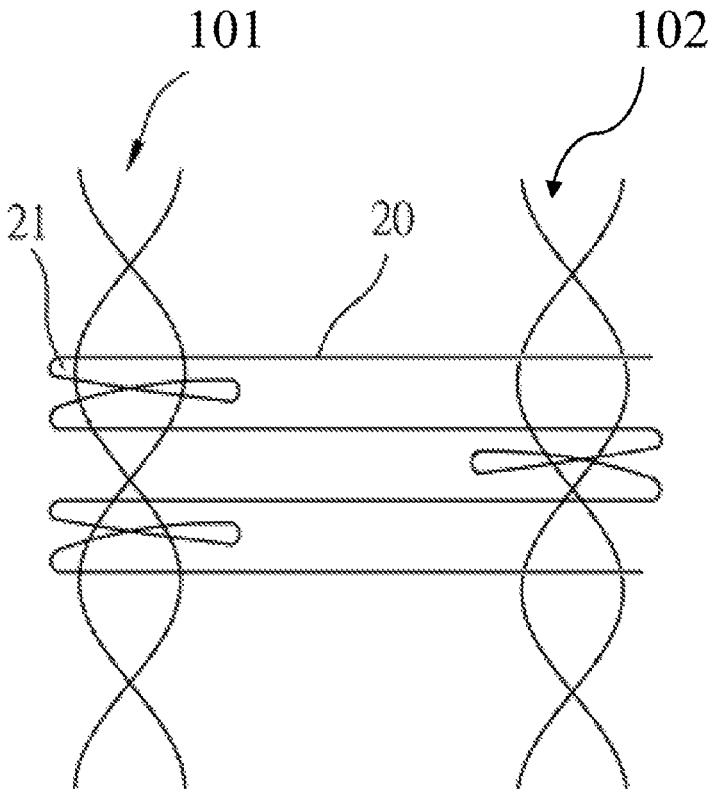
FIG. 5A to FIG. 5C are schematic structural diagrams of a fifth embodiment of the present invention.
Figure 5B:
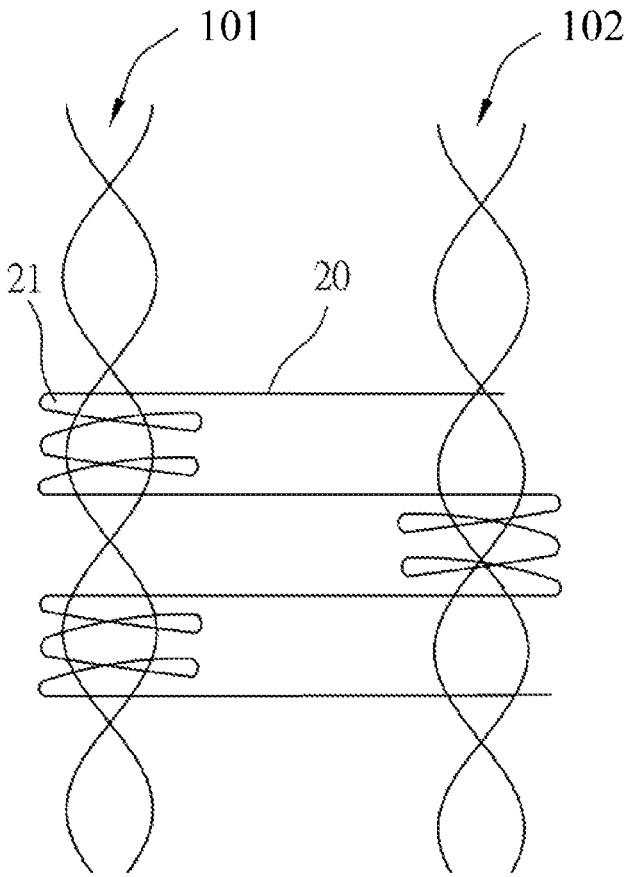
Figure 5C:
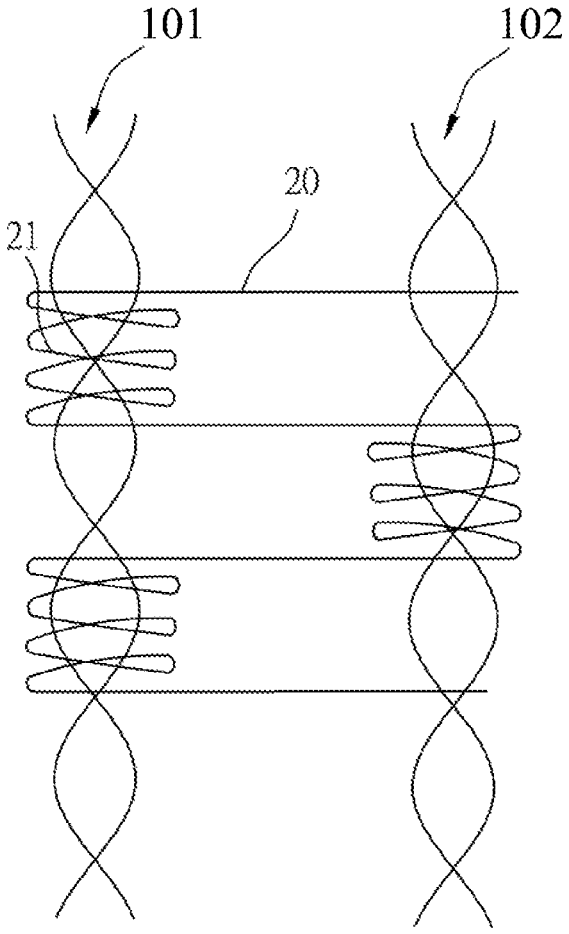

In this embodiment, the ornamental strand 20 is an opening-type yarn chain with openings. The openings twine around the first warp thread 101 and the second warp thread 102 to form a helical structure, and the number of threads of the helical structure is not particularly limited, which may be one, two, or three as shown in FIG. 5A to FIG. 5C, or may also be more than 3.

Figure 6:
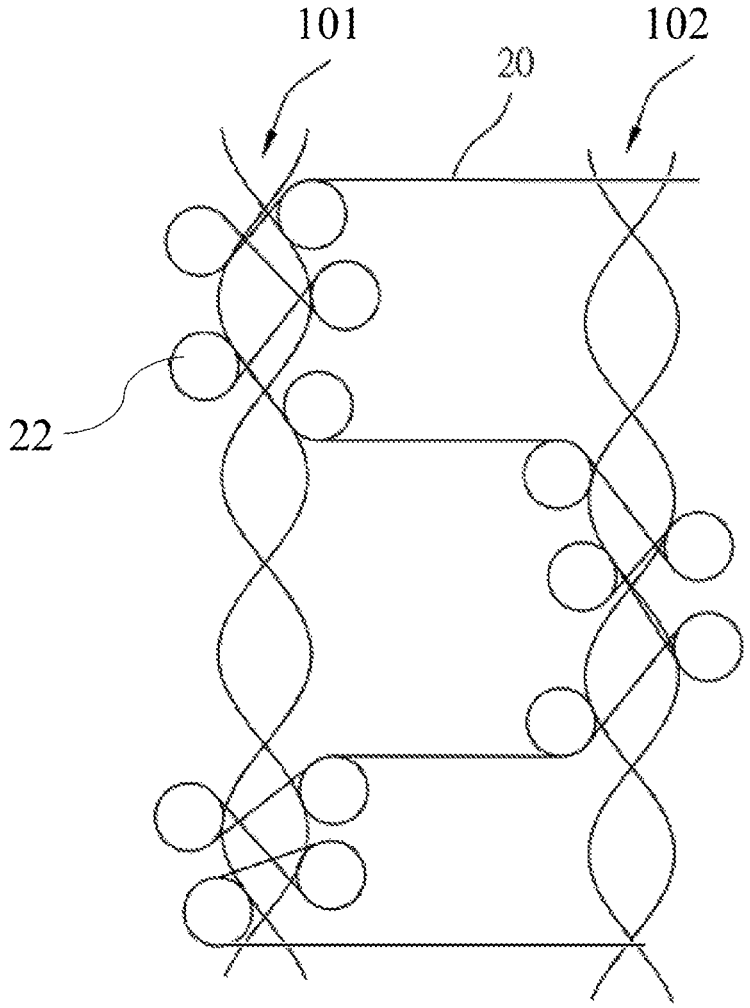
FIG. 6 is a schematic structural diagram of a sixth embodiment of the present invention.
Figure 7:
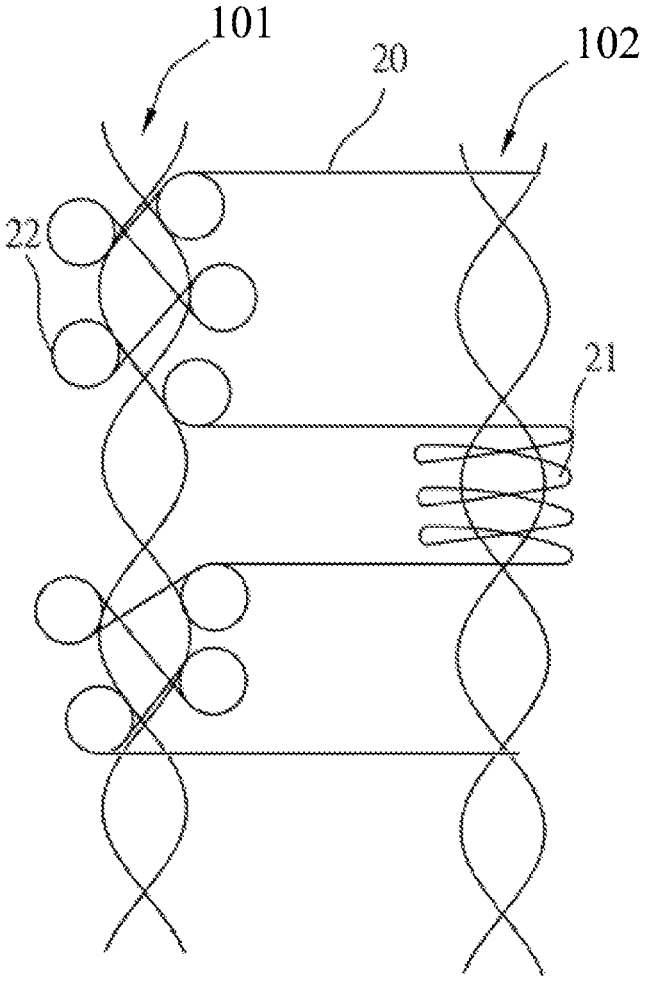
FIG. 7 is a schematic structural diagram of a seventh embodiment of the present invention.

The ornamental strand 20 may also be a closed-ring-type yarn chain with closed rings. The closed rings 22 twine around the first warp thread 101 and the second warp thread 102 to form a knot structure, as shown in a sixth embodiment of FIG. 6. Moreover, the ornamental strand 20 may also form a knot structure on the first warp thread 101, while a helical structure on the second warp thread 102, as shown in a seventh embodiment of FIG. 7.

Figure 8:
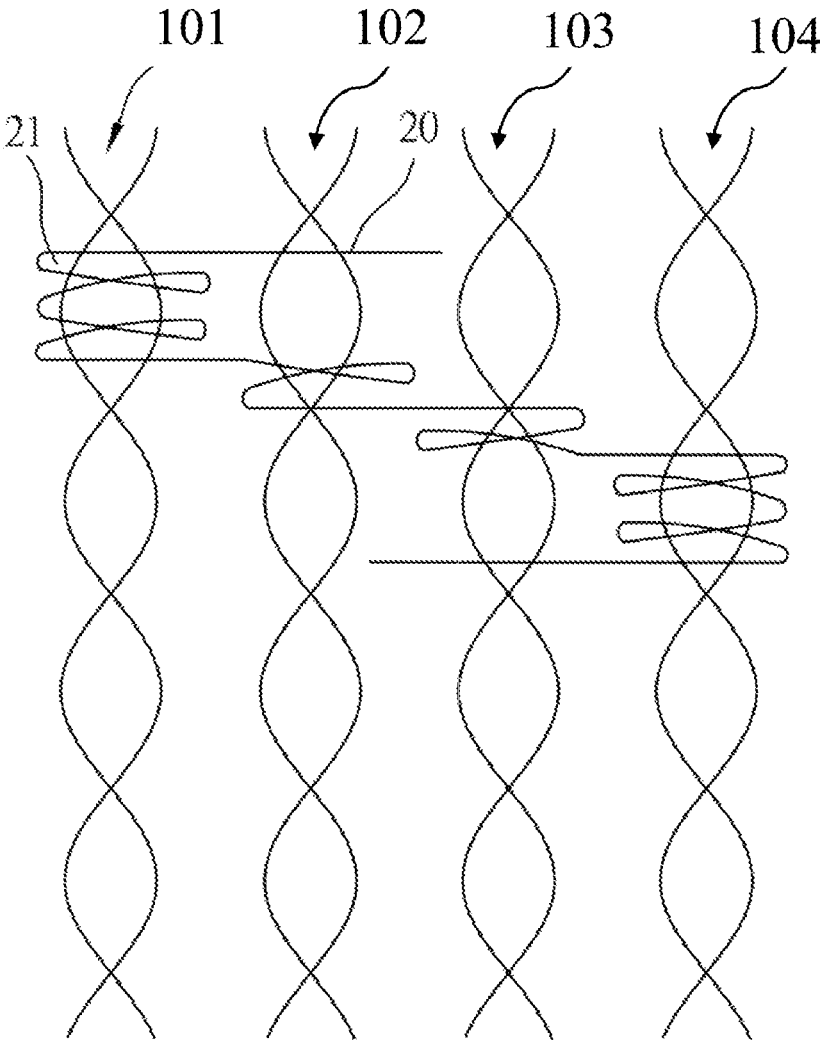
FIG. 8 is a schematic structural diagram of an eighth embodiment of the present invention.

Then, refer to FIG. 8, which shows an eighth embodiment of a recycled fancy yarn of the present invention. In this embodiment, the recycled fancy yarn includes a first warp thread 101, a second warp thread 102, a third warp thread 103, and a fourth warp thread 104, of which the structures and arrangement manners are the same as those in the foregoing embodiments, so the details are not described herein again. The ornamental strand 20 sequentially twine around the left and right adjacent warp threads to form one or multiple weft threads, and thus a crisscross structure or a net-like structure is formed. A space between any two adjacent ones of the multiple weft threads is not particularly limited, and the spaces may be the same or different. Moreover, this embodiment gives description by using an example in which there are four warp threads and one ornamental strand, but the present invention is not limited thereto. The recycled fancy yarn of the present invention may include a plurality of warp threads and a plurality of ornamental strands. The warp threads may have the same or different structures, and the ornamental strands also may have the same or different structures, such that different fancy changes can be made according to design requirements to present different patterns.

A manufacturing method of a recycled fancy yarn of the pre sent invention is described below, which includes the following steps: a step of forming a core strand: processing a single first monofilament or a single first filament buddle with a spinning machine to form a core strand; a step of forming an ornamental strand: processing a single second monofilament or a single second filament buddle with the spinning machine to form an ornamental strand; and a step of forming a fancy yarn: separately twisting the core strand and the ornamental strand that are obtained in the foregoing steps with a fancy yarn twister as required, to form at least one warp thread and at least one weft thread that are then made into a fancy yarn with a particular pattern. The first filament bundle of the core strand includes a first straight-filament bundle formed by a plurality of paralleled first monofilaments or a first twisted-filament bundle formed by a plurality of twisted first monofilaments. The second filament bundle of the ornamental strand includes a second straight-filament bundle formed by a plurality of paralleled second monofilaments or a second twisted-filament bundle formed by a plurality of twisted second monofilaments. The first monofilament and/or second monofilament is made of an environmentally friendly material, where the environmentally friendly material is a natural source material or a recyclable high-polymer material.

The manufacturing method of the recycled fancy yarn of the present invention may be as follows: For example, at least two core strands that each are formed by a single first monofilament or a single first filament bundle are fed into a fancy yarn twister from its rear roller, and then through a groove on an upper press roll of a front roller, the core strands are fixed on the fancy yarn twister. For another example, at least one ornamental strand formed by a single second monofilament or a single second filament bundle is fed into the fancy yarn twister from its front roller, and then through the groove on the upper press roll of the front roller, the ornamental strand is fixed on the fancy yarn twister. Afterwards, with the fancy yarn twister, the core strands and the ornamental strands that are obtained in the foregoing steps are output from the front roller, and wound onto a bobbin through a yarn guide hook and a wire loop; when a spindle drives the bobbin to jointly rotate, the ornamental strands drag the wire loop to rotate on an annular steel collar, to twist the strands according to the patterns shown in FIG. 1 to FIG. 8 to finally fabricate the fancy yarn with a particular pattern.

To sum up, a recycled fancy yarn of the present invention is made of a natural or a recyclable environmentally-friendly material, and by collocation and combination of core strands and ornamental strands, different fancy structures are formed, which can be widely applied in different fabrics to achieve an aesthetically decorative effect. In addition, due to the material properties, the recycled fancy yarn can be recycled or naturally decomposed in the environment, such that the quantity of produced wastes can be reduced, and environmental burden is hardly caused.

However, the specific embodiments described above are merely used to exemplify the features and functions of the present invention, and are not intended to limit the scope of the present invention. Any equivalent changes and modifications made according to the disclosure of the present invention without departing from the spirit and scope of the present invention shall all fall within the scope limited by the appended claims of the present invention.

What is claimed is:

1. A recycled fancy yarn, comprising a first warp thread, a second warp thread separated from the first warp thread by a distance and untwisted with the first warp thread, and at least one ornamental strand that is alternately wound around the first warp thread and the second warp thread to form a weft thread, the first and second warp threads being longitudinally arranged; and the at least one ornamental strand being an opening-type yarn chain having a loop uncrossing itself and a closed-ring-type yarn chain having a loop crossing itself around the multiple warp threads, and crossing the first and second warp threads to form one or multiple weft threads, wherein the at least one ornamental strand is twined, twisted or wound around the first warp thread at at least a first location and a second location, the first location being spaced from the second location, and the closed-ring-type yarn chain is formed at the first and second location, and the at least one ornamental strand is twined, twisted or wound around the second warp thread at at least a third location and a fourth location, the third location being spaced from the fourth location, and the opening-type yarn chain is formed at the third and fourth location;

each of the first and second warp threads is each formed by at least two core strands, and each of the core strands is formed by a single first monofilament or a single first filament bundle, the first filament bundle comprising a first straight-filament bundle formed by a plurality of paralleled first monofilaments or a first twisted-filament bundle formed by a plurality of twisted first monofilaments;

the ornamental strand is formed by a single second monofilament or a single second filament bundle, the second filament bundle comprising a second straight-filament bundle formed by a plurality of paralleled second monofilaments or a second twisted-filament bundle formed by a plurality of twisted second monofilaments; and the first monofilament and/or second monofilament is made of an environmentally friendly material, and the environmentally friendly material is a natural source material or a recyclable high-polymer material.

2. The recycled fancy yarn of claim 1, wherein any two adjacent weft threads of the multiple weft threads are equally or unequally spaced.

3. The recycled fancy yarn of claim 1, wherein there is a plurality of ornamental strands, and each ornamental strand twines around the first and second adjacent warp threads to form a closed structure.

4. The recycled fancy yarn of claim 1, wherein the opening-type yarn chain and the closed-ring-type yarn chain are alternately arranged.

* * * * *